US007044774B2

(12) United States Patent
Asai

(10) Patent No.: US 7,044,774 B2
(45) Date of Patent: May 16, 2006

(54) CONNECTOR FOR A FLEXIBLE BOARD

(75) Inventor: Kiyoshi Asai, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 11/116,015

(22) Filed: Apr. 27, 2005

(65) Prior Publication Data

US 2006/0040547 A1 Feb. 23, 2006

(30) Foreign Application Priority Data

Aug. 20, 2004 (JP) ..... 2004-241709

(51) Int. Cl.
*H01R 12/24* (2006.01)

(52) U.S. Cl. ..... 439/495

(58) Field of Classification Search ..... 439/357, 439/492–497

See application file for complete search history.

(56) References Cited

U.S. PATENT DOCUMENTS 5,100,342 A * 3/1992 Olsson ..... 439/497
5,378,161 A * 1/1995 Loder ..... 439/77
5,906,504 A * 5/1999 Igarashi et al. ..... 439/495
5,967,831 A * 10/1999 Yamada et al. ..... 439/496
6,273,748 B1 * 8/2001 Komatsu et al. ..... 439/496

* cited by examiner

*Primary Examiner*—Khiem Nguyen
(74) *Attorney, Agent, or Firm*—Darby & Darby

(57) ABSTRACT

The connector for a flexible board is equipped with a housing, a plurality of contacts, and a cover. The plurality of contacts are placed so that their contact parts are in two rows along opposing inner wall surfaces of an insertion concavity of the housing. By inserting a pressure-applying part of the cover into the insertion concavity, a flexible printed circuit board (FPC), which has been guided between the cover and the insertion concavity, is pushed in and deformed and held sandwiched between the cover and the insertion concavity, and each contact part of the FPC comes into contact with the contact part of the corresponding contact. The number of contacts capable of being housed within the connector is increased two-fold from that of prior art connectors and the number of contact parts in the flexible board is increased two-fold. Furthermore, operation of the connector is easier.

10 Claims, 12 Drawing Sheets

CONNECTOR FOR A FLEXIBLE BOARD

INCORPORATION BY REFERENCE

The present application claims priority under 35 U.S.C. §119 to Japanese Patent Application No. 2004-241709 on Aug. 20, 2004. The content of the application is incorporated herein by reference in its entirety.

FIELD OF THE INVENTION

The present invention generally relates to connectors for flexible boards. More specifically, the present invention relates to a flexible board connector for electrically connecting a flexible board, such as a flexible printed circuit board (FPC) or a flexible flat cable (FFC), to a printed circuit board.

BACKGROUND OF THE INVENTION

In the prior art, with this type of flexible board connector, the flexible board is inserted with a low insertion force so that there is no pressure from the contacts during insertion of the flexible board. After insertion of the flexible board, a stable electrical connection is achieved by contacting the contacts with a prescribed pressure. This is known as a zero insertion force construction.

For example, as shown in FIGS. 12A and 12B, a housing 103 houses and retains a plurality of contacts 101. A slider 105 can slide into housing 103. An operating lever 109 is rotatably supported on housing 103 via reinforcement metal fittings 107. Operating lever 109 is rotated in a counterclockwise direction, and as shown in FIG. 12A, slider 105 is moved towards the left so that it is pulled out. In addition, the front side is moved higher than horizontal plane H. After inserting FPC 111 with a low insertion force, operating lever 109 is rotated in the clockwise direction indicated in FIG. 12A, and slider 105 is moved towards the right. FPC 111 is moved to a prescribed position, and its contact parts contact the contact parts of contact 101 having a prescribed elasticity and are locked (see, for example, Japanese Laid-Open Patent Publication Number 2003-317838).

However, with the conventional example shown in FIGS. 12A and 12B, the plurality of contacts 101 that are housed in housing 103 is arranged in one row along a set direction (in FIGS. 12A and 12B, the front-back direction from the paper surface). As a result, there is a limit to the number of contacts 101 that can be housed in the connector, and therefore it is difficult to increase the number of contact parts of FPC 111.

In addition, FPC 111 is inserted when operating lever 109 is rotated in the counterclockwise direction and slider 105 is pulled out, and then after insertion of FPC 111, operating lever 109 is rotated in the clockwise direction to lock it. This results in a complicated operation.

SUMMARY OF THE INVENTION

The present invention takes into consideration the above problems and provides a connector for a flexible board in which the number of contact elements of the flexible board is doubled by doubling the number of contacts that can be housed inside the connector. In addition, the operation is made easier.

The connector for a flexible board, according to an embodiment of the present invention, includes a housing in which an insertion concavity is formed, a plurality of contacts which are retained in the housing and have contact parts that face the inside of the insertion concavity, and a cover having a pressure applying part which can be inserted into and removed from the insertion concavity. The plurality of contacts have their contact parts arranged in two rows along opposing inner walls of the insertion concavity. By inserting the pressure applying part into the insertion concavity, a flexible board which has been guided to between the cover and the insertion concavity is pushed and deformed and is held interposed between them, and a contact part of the flexible board is brought into contact with a contact part of a corresponding contact.

Thus, the present invention provides a flexible board connector equipped with a housing, a plurality of contacts, and a cover, in which the plurality of contacts have their contact parts arranged in two rows along opposing inner walls of the insertion concavity. By inserting the pressure applying part into the insertion concavity, a flexible board which has been guided to between the cover and the insertion concavity is pushed and deformed and is held interposed between them, and a contact part of the flexible board is brought into contact with a contact part of a corresponding contact. Because of this construction, the number of contacts that can be housed in the connector is doubled, and the number of contact parts (contact pads for example) of the flexible board can be doubled. In addition, there is no need for a rotating operation, and the operation is improved.

Protruding pieces used for positioning can be formed on the flexible board; and the protruding pieces can be shaped to approximately overlap with areas on the surface at both ends of the insertion concavity when the flexible board is guided between the cover and the insertion concavity. Positioning parts can be provided on the housing which join with the edges of the protruding pieces and position the flexible board.

With a flexible board connector as described above, protruding pieces are formed on the flexible board. Positioning parts are formed on the housing. The protruding pieces are shaped to approximately overlap with areas on the surface at both ends of the insertion concavity when the flexible board is guided between the cover and the insertion concavity. Positioning parts join with the edges of the protruding pieces and position the flexible board. Because of this construction, the positioning of the flexible board with respect to the housing is done easily.

The positioning parts can include insertion stoppers which stop insertion of the flexible board by coming into contact with a front edge of the protruding pieces of the flexible board and joining protrusions which provisionally position the flexible board by joining with a back edge of the protruding pieces.

With a flexible board connector as described above, the positioning parts are formed from insertion stoppers and joining protrusions. Insertion stoppers stop insertion of the flexible board by coming into contact with the front edge of the protruding pieces of the flexible board. Joining protrusions provisionally position the flexible board by joining with a back edge of the protruding pieces. As a result of this construction, the positioning of the flexible board with respect to the housing is easy and accurate.

Joining tabs can be formed on the cover at positions on both sides of the pressure-applying part, and together with the pressure applying part, the joining tabs can join with the surface of the protruding pieces during insertion of the pressure applying part into the insertion concavity.

With a flexible board connector as described above, joining tabs are formed on the cover at positions on both sides of the pressure-applying part. During insertion of the pressure applying part into the insertion concavity, the joining tabs, together with the pressure applying part, join with the surface of the protruding pieces. As a result of this construction, by inserting the pressure applying part into the insertion concavity, the flexible board which is sandwiched between the cover and the insertion concavity is prevented from slipping out. In addition, positioning of the flexible board and the contact parts of the corresponding contact is done reliably.

Arms can be provided on the cover which face the outer wall surface of the housing when inserting the pressure applying part into the insertion concavity. Hooks can be formed on the outer wall of the housing and the opposing wall of the arms and can join with each other during insertion and removal of the pressure applying part to prevent slipping. Positioning protrusions can be formed on at least one of the surfaces of either the outer wall of the housing or the opposing wall of the arms for positioning during insertion and removal of the pressure applying part with respect to the insertion concavity.

With a flexible board connector as described above, arms are formed on both sides of the cover, and hooks are formed on the outer wall of the housing and the opposing surface of the arms. On at least one of the surfaces of either the outer wall of the housing and the opposing surface of the arms, positioning protrusions are formed. This prevents the pressure applying part from slipping out during insertion and removal and positions the pressure applying part with respect to the insertion concavity during removal and insertion. As a result of this construction, the operation of guiding the flexible board between the cover and the insertion concavity and the operation of insertion and removal of the cover with respect to the insertion concavity are made easier, and the operation is improved.

BRIEF DESCRIPTION OF THE FIGURES

The foregoing and other features of the present invention will be more readily apparent from the following detailed description and drawings of the illustrative embodiments of the invention wherein like reference numbers refer to similar elements and in which.

DETAILED DESCRIPTION OF THE PREFERRED EMBODIMENTS

Figure 1A:
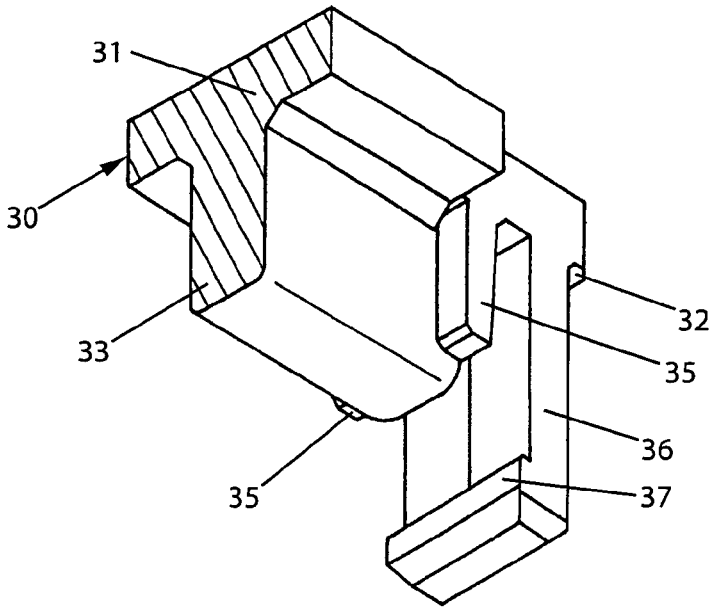
FIG. 1 is an exploded cross-sectional perspective view showing a connector for a flexible board according to an embodiment of the present invention.
Figure 1B:
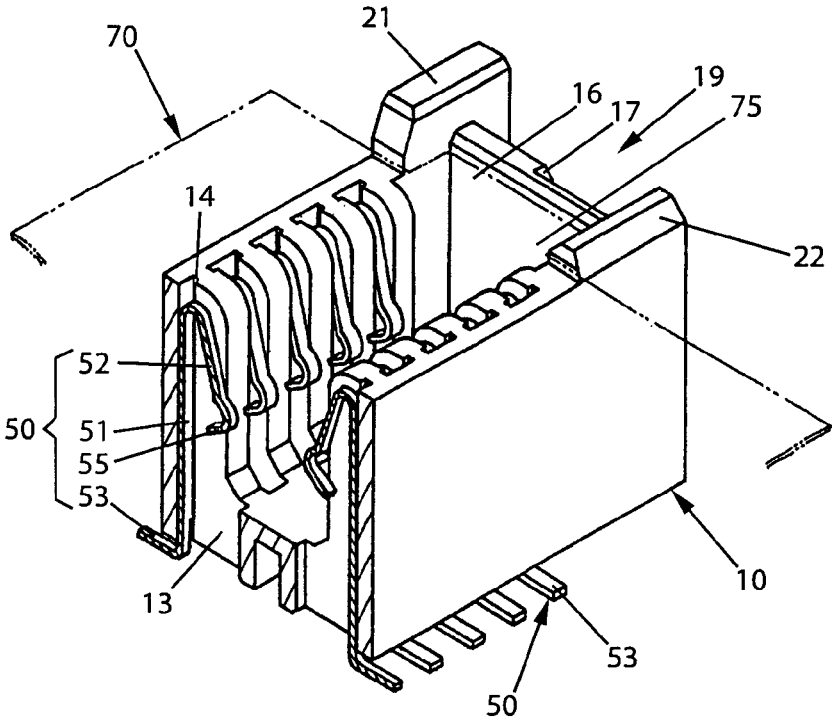
Figure 2A:
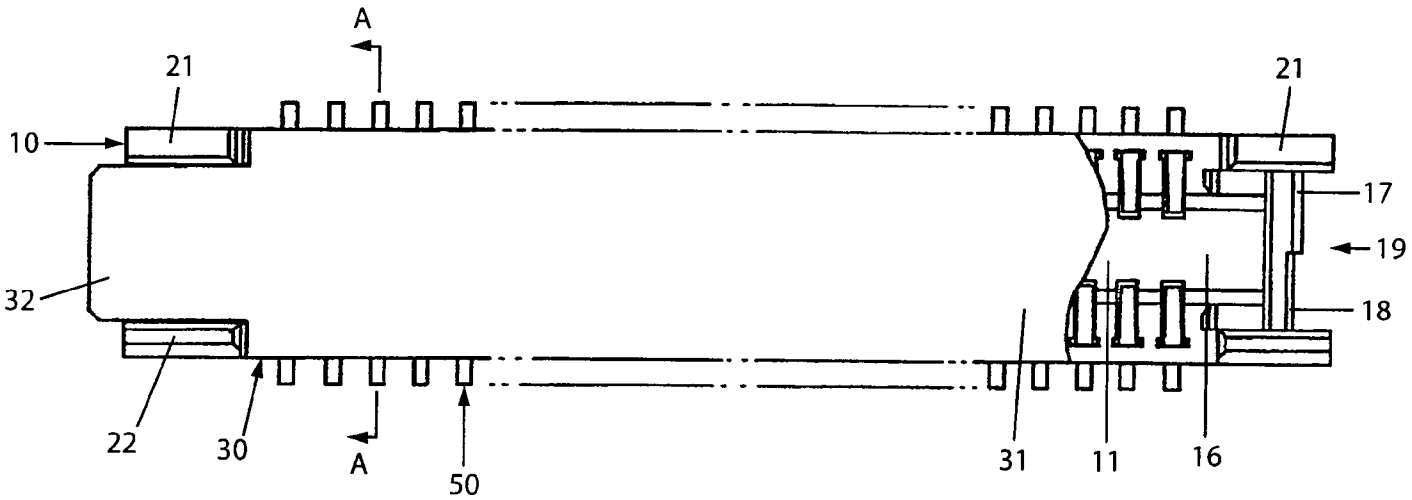
FIG. 2A is a cross-sectional plan view of the connector of FIG. 1 with a section omitted.
Figure 2B:
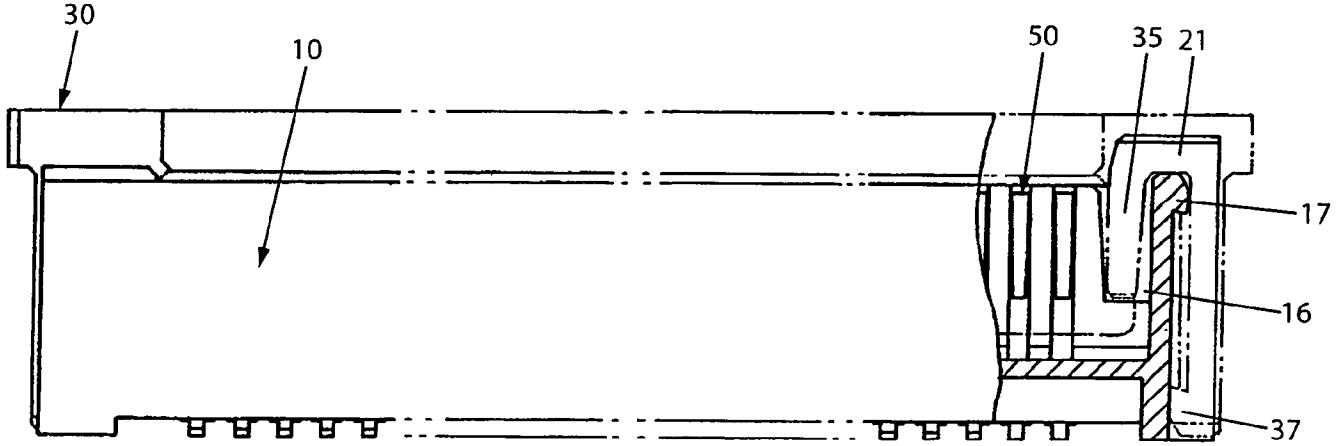
FIG. 2B is a cross-sectional front view of the connector of FIG. 1 with a section omitted.
Figure 3A:
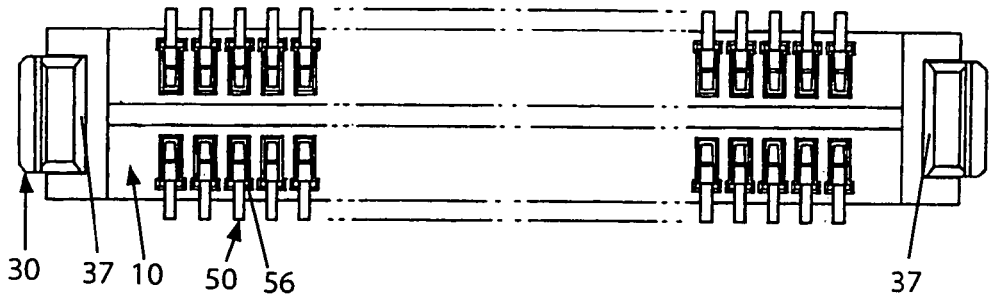
FIG. 3A is a bottom view of the connector of FIG. 2A.
Figure 3B:
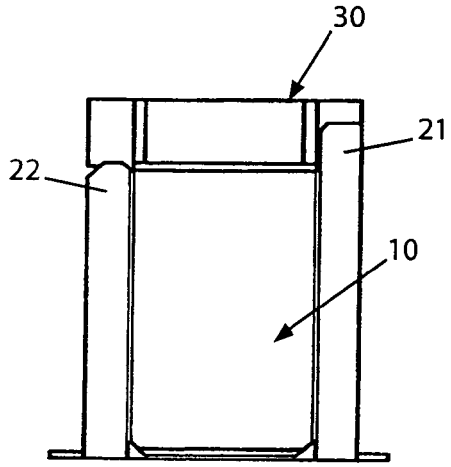
FIG. 3B is a right side view of the connector of FIG. 2B.
Figure 3C:
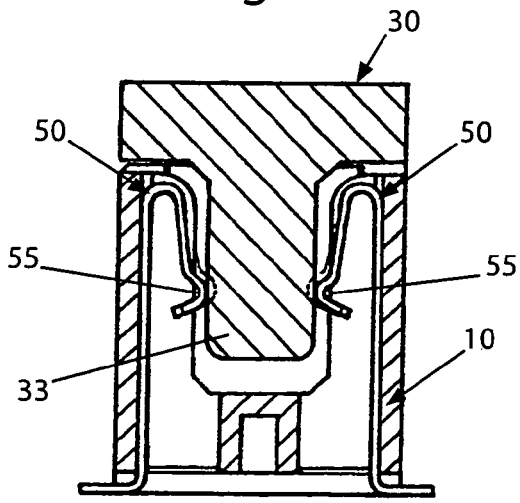
FIG. 3C is a cross-sectional side view along line A—A of the connector of FIG. 2A.
Figure 4A:
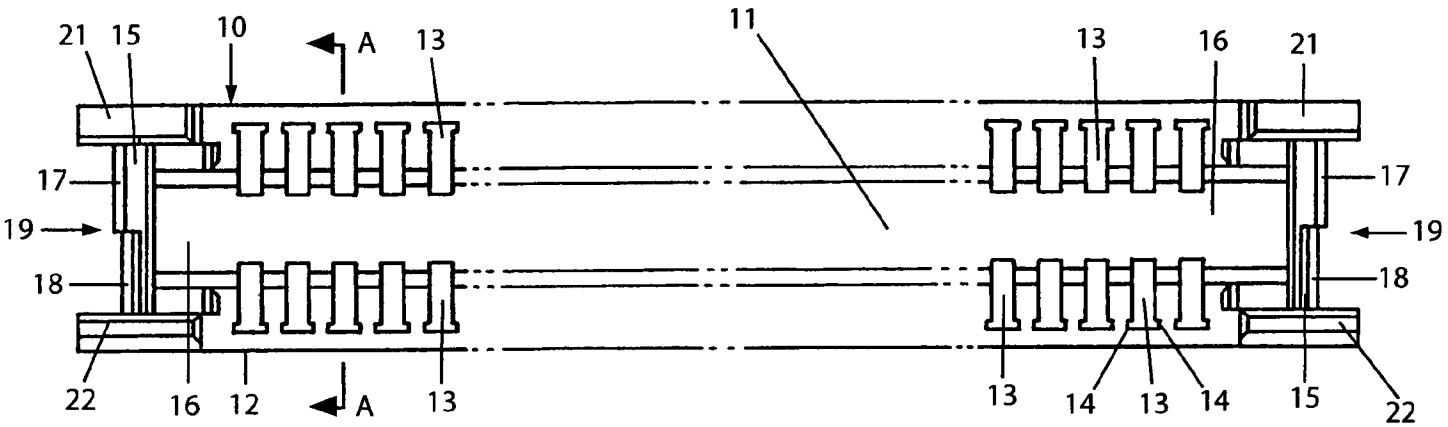
FIG. 4A is a plan view of a housing of the connector of FIGS. 1–3 with a section omitted.
Figure 4B:
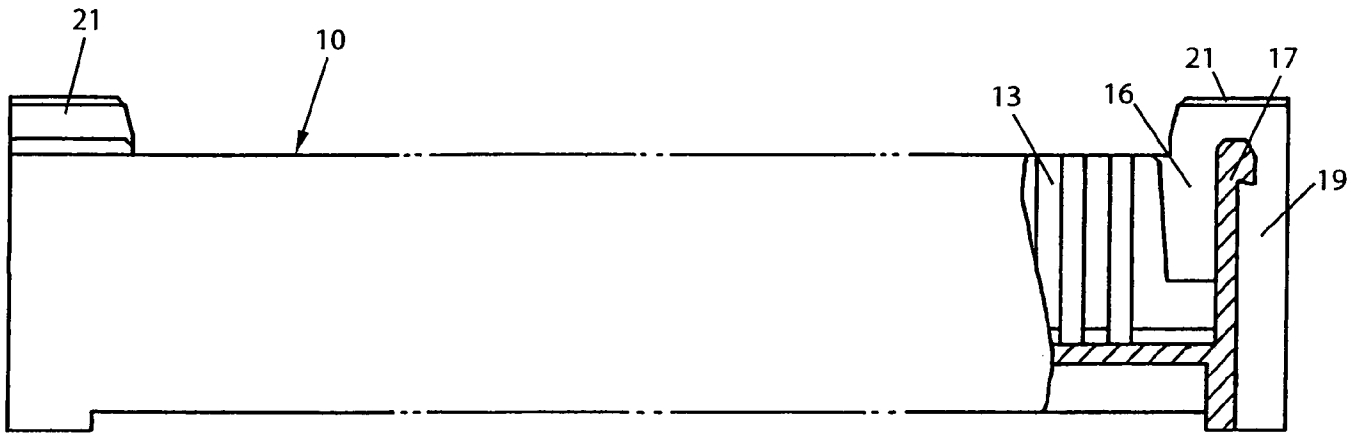
FIG. 4B is a cross-sectional front view of the housing of FIG. 4A with a section omitted.
Figure 5A:
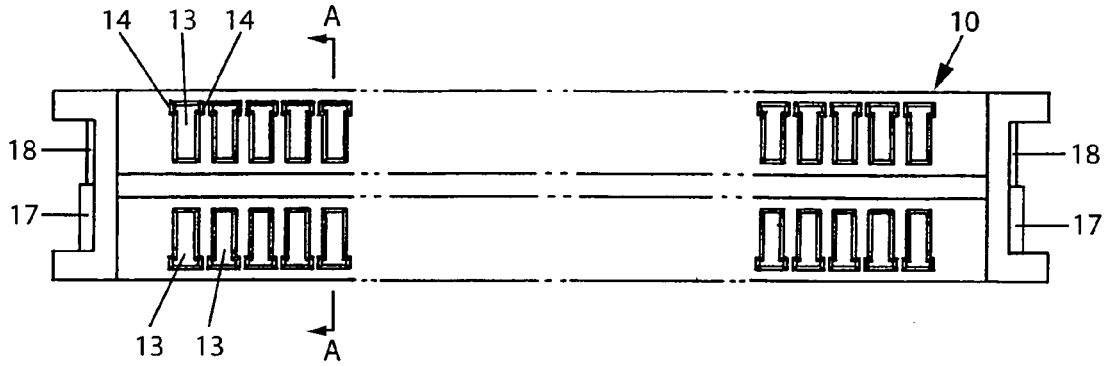
FIG. 5A is a bottom view of the housing of FIG. 4A.
Figure 5B:
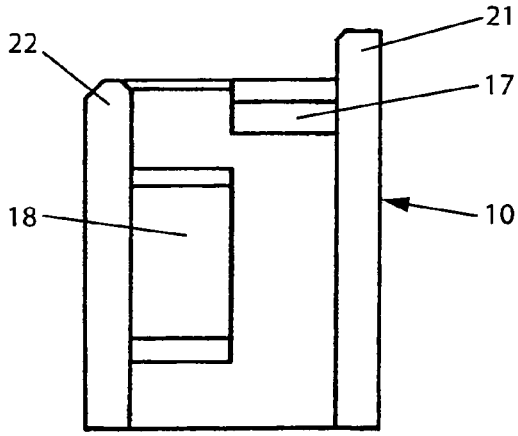
FIG. 5B is a right side view of the housing of FIG. 4B.
Figure 5C:
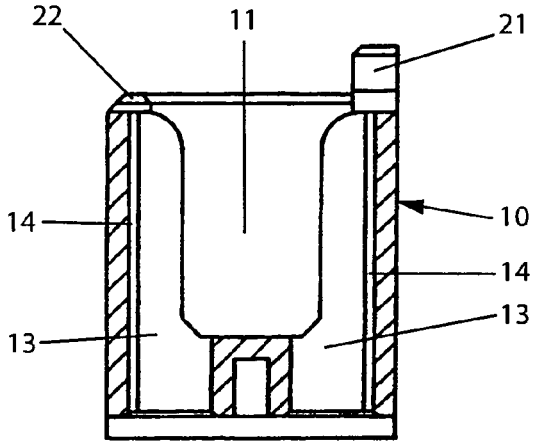
FIG. 5C is a cross-sectional side view along line A—A of the housing of FIG. 4A.
Figure 6A:
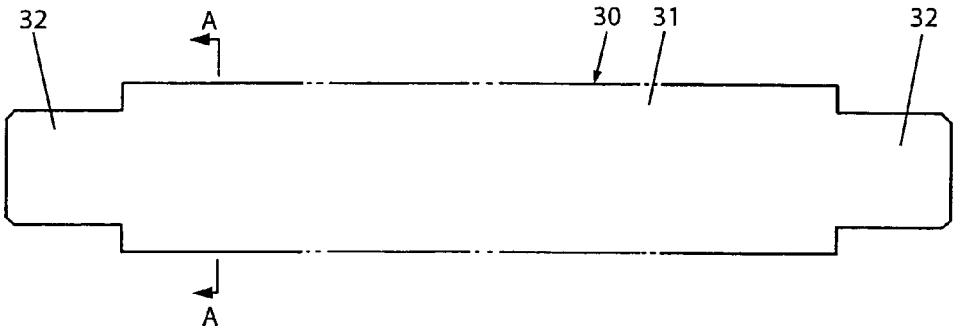
FIG. 6A is a plan view of a cover of the connector of FIGS. 1–3 with a section omitted.
Figure 6B:
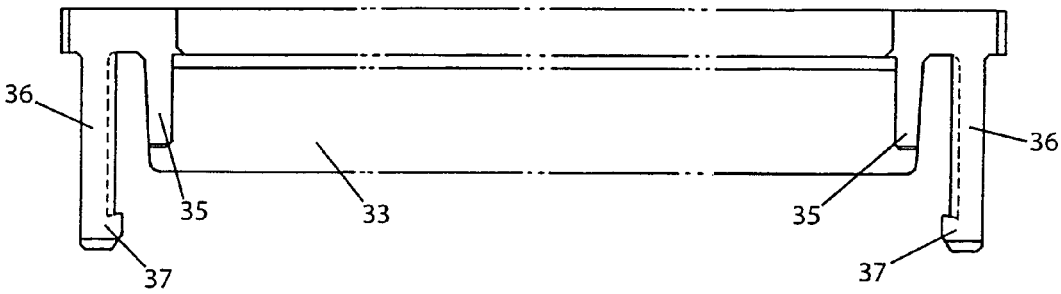
FIG. 6B is a cross-sectional front view of the cover of FIG. 6A with a section omitted.
Figure 7A:
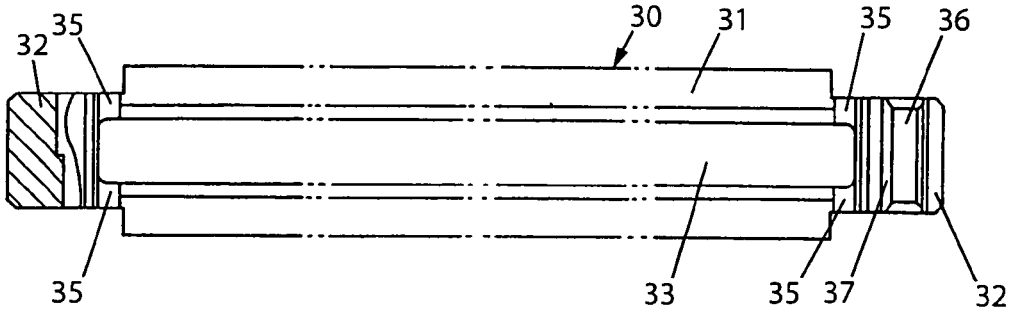
FIG. 7A is a bottom view of the cover of FIG. 6A.
Figure 7B:
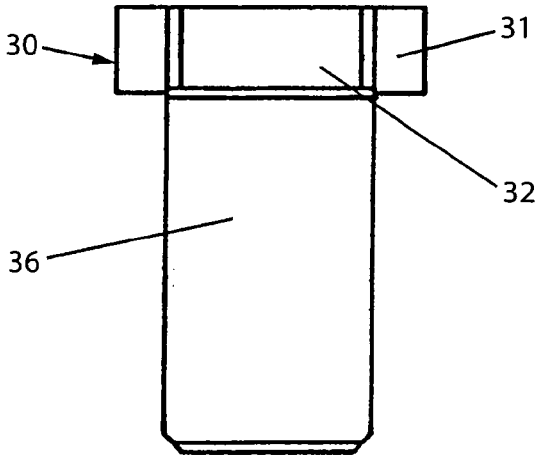
FIG. 7B is a right side view of the cover of FIG. 6B.
Figure 7C:
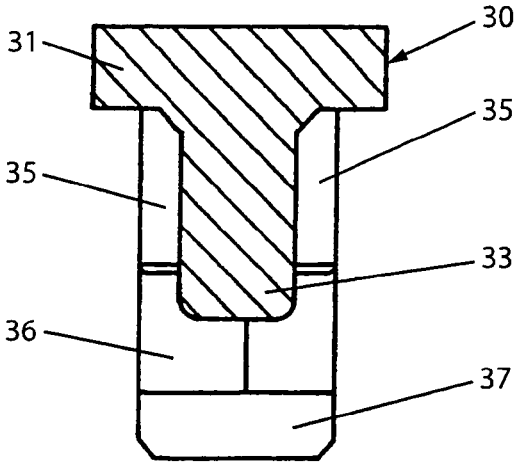
FIG. 7C is a cross-sectional side view along line A—A of the cover of FIG. 6A.

Referring to FIGS. 1–3, there is shown one embodiment of the connector for a flexible board of the present invention. In these figures, there is a housing 10, a cover 30, a contact 50, and as one example of a flexible board there is a FPC 70.

Housing 10 is formed from insulating synthetic resin. As shown in FIGS. 4A, 4B, 5A, and 5B, housing 10 has an opening on the upper surface to form an insertion concavity 11. Housing 10 is formed approximately as an oblong box-shape.

On side walls 12 along the length direction of housing 10, a plurality (for example, 90–100) of contact insertion holes 13 is formed at a prescribed pitch in two parallel rows (for example, 45–50 in each row at a pitch of 1.25 mm).

Contact insertion holes 13 vertically penetrate side walls 12 of housing 10 and are also open towards the interior of insertion concavity 11. In one part of each contact insertion hole 13, there are latching grooves 14 for latching with contact 50.

Side walls 15 are the walls along the cross-direction of housing 10. Joining concavities 16 are formed to the inside of side walls 15 in an area corresponding to the sides of insertion cavity 11. On the outer wall surface of side walls 15, there are hooks 17 and positioning protrusions 18.

Hooks 17 protrude as hooks to the outside from the upper end of side walls 15. As shown in the plan view of FIG. 4A, they are positioned on the upper side (the upper side of FIG. 4A). Positioning protrusions 18 are formed protruding towards the outside from the central part of side walls 15. As shown in the plan view of FIG. 4A, they are positioned on the lower side (the lower side of FIG. 4A).

Both ends of side walls 12 protrude outward from the wall surfaces of side walls 15, and side walls 12 and side walls 15 form C-shaped and reverse C-shaped joining concavities 19.

In an area which is at the upper part of both sides of side walls 12 and is opposite the upper part of joining concavities 16 and 19, insertion stoppers 21 and joining protrusions 22 are formed. Insertion stoppers 21 and joining protrusions 22 form positioning parts. As shown in the plan view of FIG. 4A, insertion stoppers 21 are positioned on the upper side (the upper side of FIG. 4A), and the protruding length is longer than joining protrusions 22. Joining protrusions 22 are positioned on the lower side.

Cover 30 is formed from insulating synthetic resin. Cover 30 is formed so that it joins with insertion concavity 11 of housing 10 and covers the opening part of insertion concavity 11. Referring to FIGS. 6A, 6B, and 7A–7C, cover 30 has a cover body 31, attachment side piece 32, pressure applying part 33, joining tabs 35, and arms 36.

Cover body 31 is formed in an oblong rectangular shape which covers a large proportion of insertion concavity 11.

Attachment side pieces 32 extend outward from both ends in the length direction of cover body 31 and are formed in a rectangular shape which covers the openings of joining concavities 16 and 19 of housing 10.

Pressure applying part 33 protrudes downward from the lower surface of cover body 31 and a portion of attachment side pieces 32. Pressure applying part 33 is formed so that it can join with insertion concavity 11 of housing 10.

Joining tabs 35 protrude downward from the lower side of attachment side pieces 32 and are positioned on either side of pressure applying part 33. Joining tabs 35 are formed so that they join with the corresponding part of joining concavities 16.

Arms 36 protrude downward from the lower side of attachment side pieces 32 and are formed to join with joining concavities 19. When arms 36 are joined with joining concavities 19, the area opposite hooks 17 are thinner than the area opposite protrusions 18. The ends of arms 36 are provided with hooks 37 which protrude inward.

Contacts 50 are formed by stamping or bending a conductive metal plate, as shown in FIGS. 1–3. Contact 50 has an attachment piece 51 which is formed as a long thin strip, a movable piece 52 which extends from one end of attachment piece 51 and is bent back towards the interior, and a connecting piece 53 which extends from the other end of attachment piece 51 and is bent roughly at a right angle towards the exterior.

At the end of movable piece 52, a contact part 55 is formed. On both sides of attachment piece 51, there are latching protrusions 56.

Figure 8:
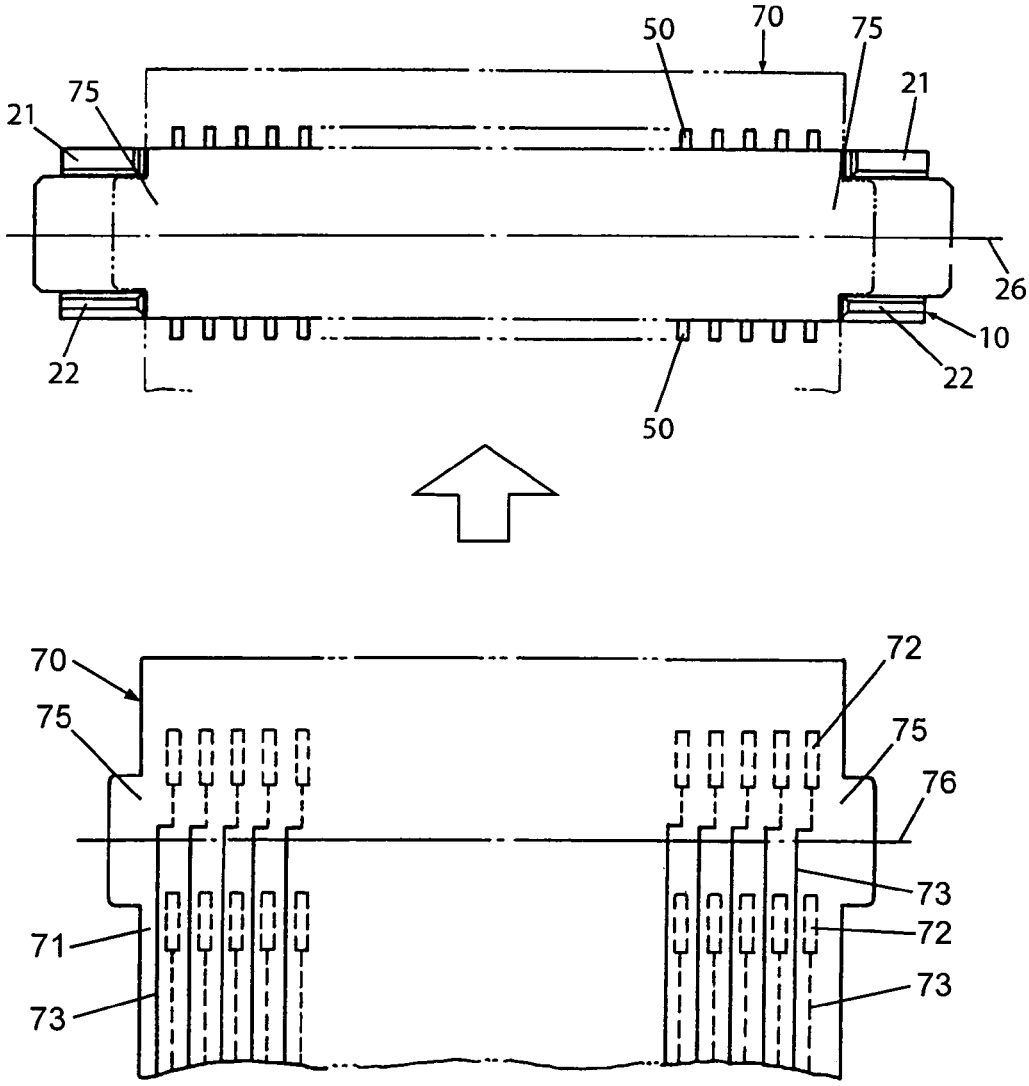
FIG. 8 is a plan view showing a FPC guided between a housing and a cover according to an embodiment of the present invention.

As shown in FIG. 8, FPC 70 has a main board body 71 which is formed from a base material such as polyester film, a plurality of contact parts 72 (for example, 45–50 in one row and 90–100 in two rows), and a circuit pattern 73 which is connected to each contact part 72.

At either end of main board body 71, protruding pieces 75 are provided to join with the upper part of joining concavities 16 of housing 10 at the time of insertion into the connector.

The plurality of contact parts 72 are positioned symmetrically with respect to a center line 76 of protruding pieces 75.

Figure 9A:
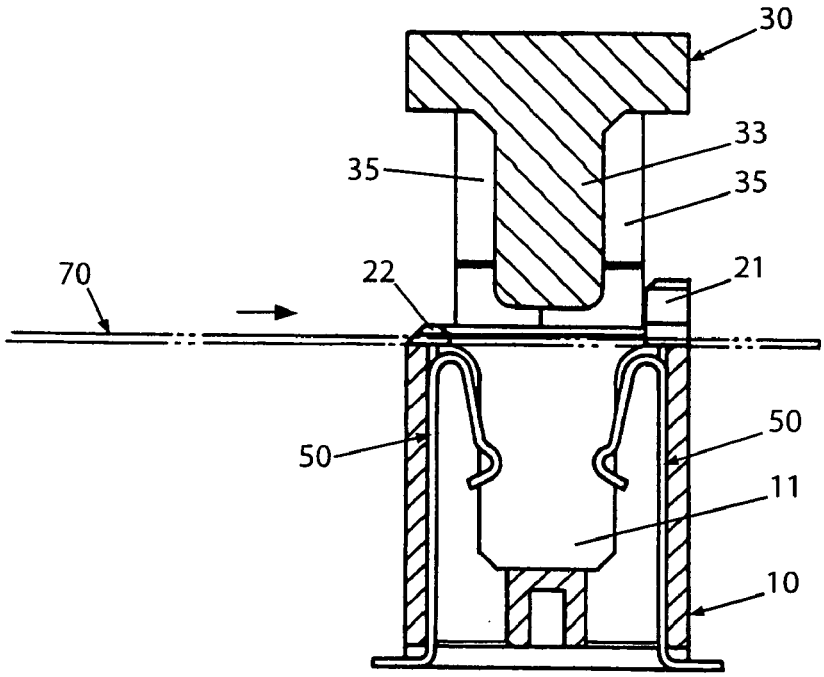
FIG. 9A is a cross-sectional side view showing a FPC guided between a housing and a cover.
Figure 9B:
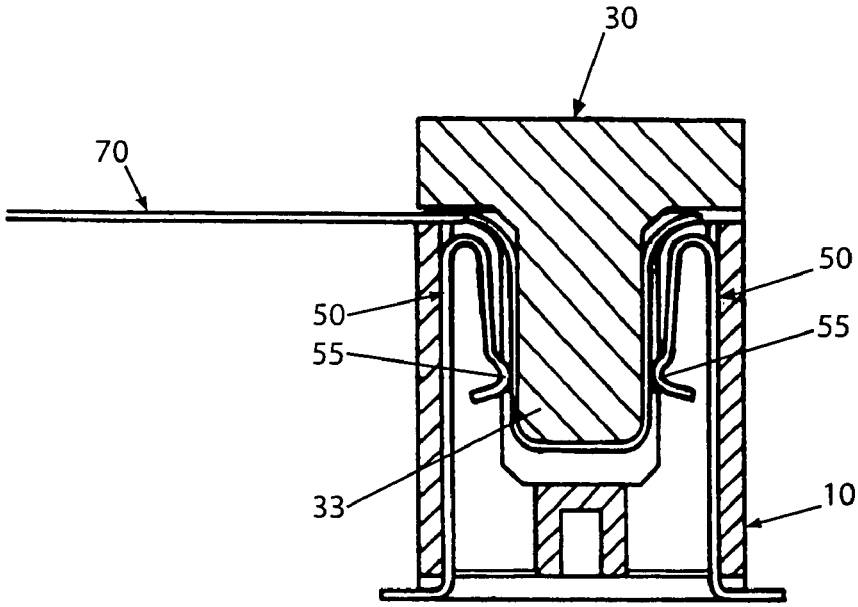
FIG. 9B is a cross-sectional side view showing the elastic contact of a FPC and a contact part of a contact by a pressure applying part of a cover.

Next, referring to FIGS. 9A and 9B, the assembly method of the connector is described.

Contacts 50 are built into the inside of housing 10 by inserting contacts 50 into contact insertion holes 13 of housing 10 from its bottom side.

At this time, when inserting contact 50 into contact insertion hole 13, latching protrusions 56 of attachment piece 51 are pushed and latched into latching grooves 14. The end of movable piece 52 protrudes out into insertion concavity 11, and contact part 55 is positioned inside insertion concavity 11. In addition, connecting piece 53 protrudes to the exterior of housing 10.

Next, arms 36 of cover 30 join with joining concavities 19, and hooks 37 join between hooks 17 and positioning protrusions 18 of housing 10. Housing 10 is then ready for insertion of FPC 70 as shown in FIG. 9A.

When FPC 70 is not inserted, cover 30 is pushed downward, and pressure applying part 33 joins with insertion concavity 11. In addition, hooks 37 of arms 36 join below positioning protrusion 18 of housing 10. As shown in FIGS. 2A, 2B, and 3A–3C, this is a storage condition for cover 30.

Next, referring to FIGS. 8, 9A, and 9B, the action of the embodiment described above is described.

From the storage condition for cover 30 shown in FIGS. 2 and 3, cover 30 is pulled upward so that hooks 37 of arms 36 join with housing 10 between hooks 17 and positioning protrusions 18. This results in a condition of cover 30 that is ready for insertion of FPC 70.

Next, FPC 70 is guided between housing 10 and cover 30 from a prescribed direction (from the bottom of the page in FIG. 8 and from the left in FIG. 9A).

At this time, protruding pieces 75 of FPC 70 are positioned at the upper part of joining concavities 16 by insertion stoppers 21 and joining protrusions 22 of housing 10. As shown in the plan view of FIG. 8, FPC 70 is positioned so that center line 76 of FPC 70 approximately coincides with center line 26, which extends in the longitudinal direction of housing 10. In other words, insertion stoppers 21 contact the front ends of protruding pieces 75 and prevent further insertion. Joining protrusions 22 contact the back ends of protruding pieces 75 and prevent FPC 70 from slipping out.

Figure 10:
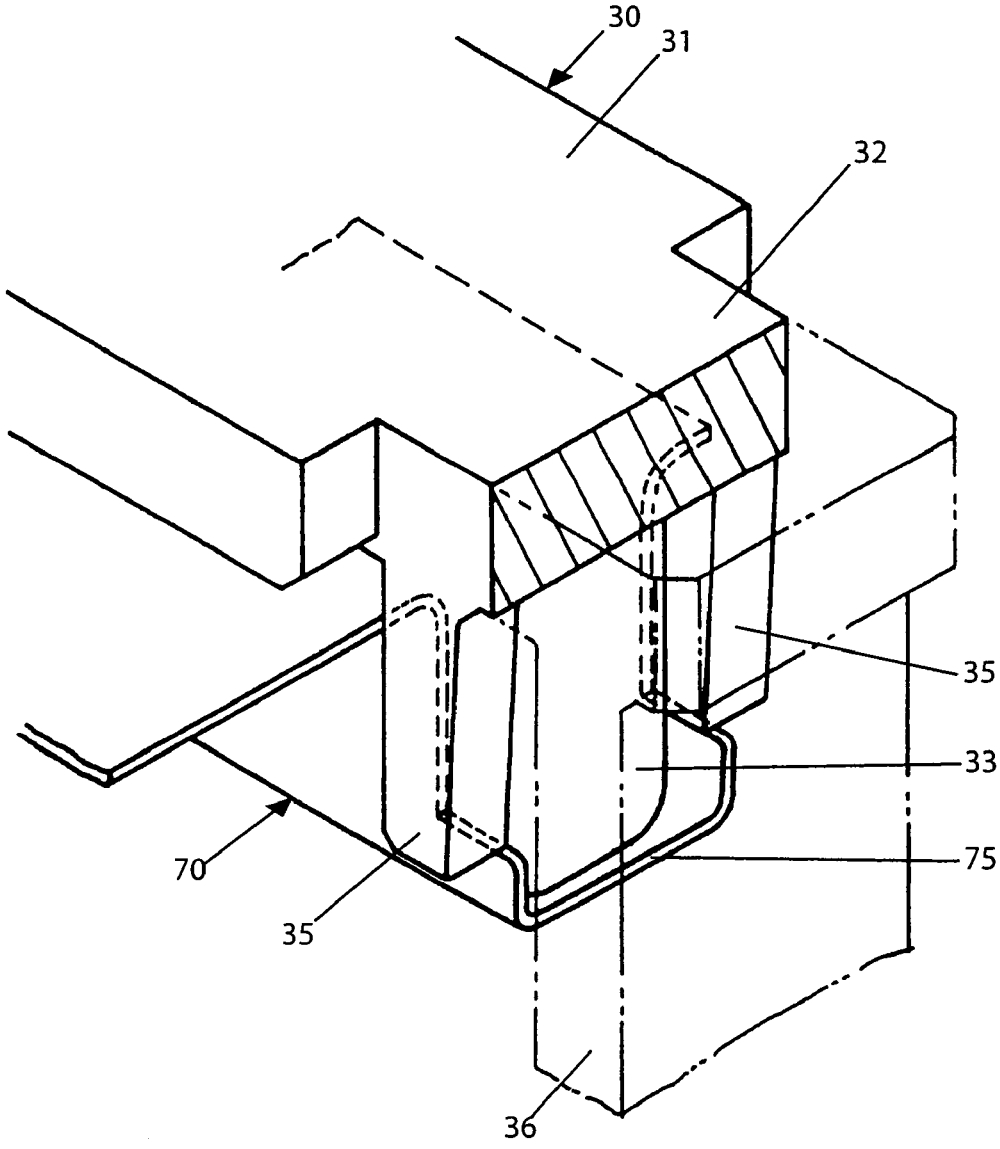
FIG. 10 is a partial perspective view showing protruding pieces of a FPC being pressed and bent by a pressure applying part and joining tabs of a cover and being positioned to a prescribed position inside joining concavities of a housing.

Next, cover 30 is pushed downward. Pressure applying part 33 joins with insertion concavity 11. In addition, hooks 37 of arms 36 join with housing 10 below positioning protrusions 18. This results in a connected condition as shown in FIG. 9B and FIG. 10.

In this connected condition, FPC 70 is pushed and bent into an approximate U-shape by pressure applying part 33. Contact parts 72 come into elastic contact with the corresponding contact part 55 of contact 50.

In addition, when pushing down cover 30 into housing 10, together with the ends of pressure applying part 33, joining tabs 35 of attachment side pieces 32 join with protruding pieces 75 of FPC 70. Protruding pieces 75 are pushed down inside joining concavities 16. After joining is completed, as shown in FIG. 10, protruding pieces 75 are bent into an approximate U-shape. As a result, the contact positions for contact parts 72 and the corresponding contact parts 55 of contacts 50 can be accurately matched.

In the embodiment described above, with housing 10, a plurality of contacts 50 are formed in two rows which are symmetrical with respect to center line 26 of housing 10. FPC 70 also has a plurality of contact parts 72 formed in two rows which are symmetrical with respect to center line 76 of FPC 70. However, the present invention is not limited to this embodiment.

Figure 11:
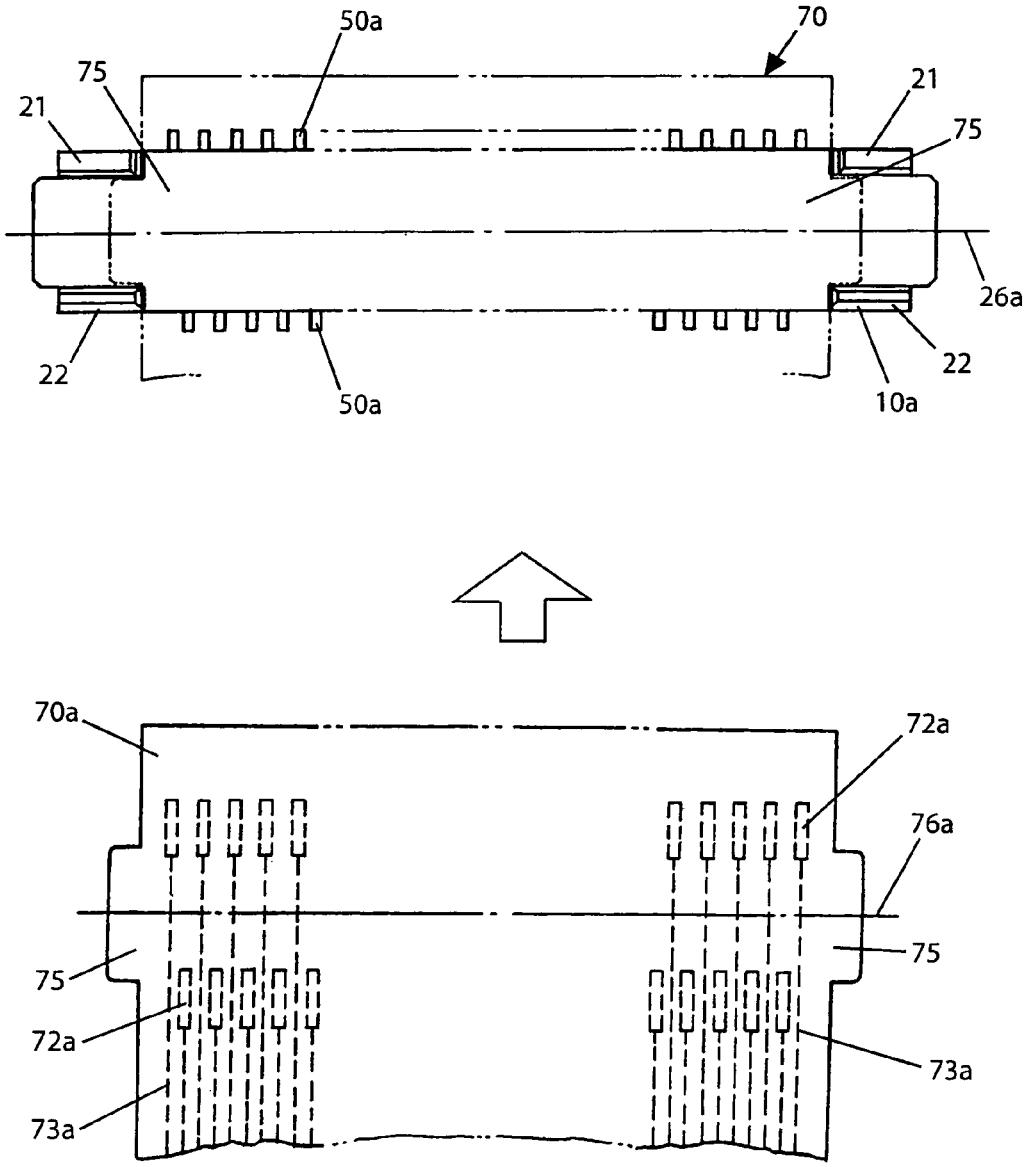
FIG. 11 is a plan view showing a FPC guided between a housing and a cover according to another embodiment of the present invention.
Figure 12A:
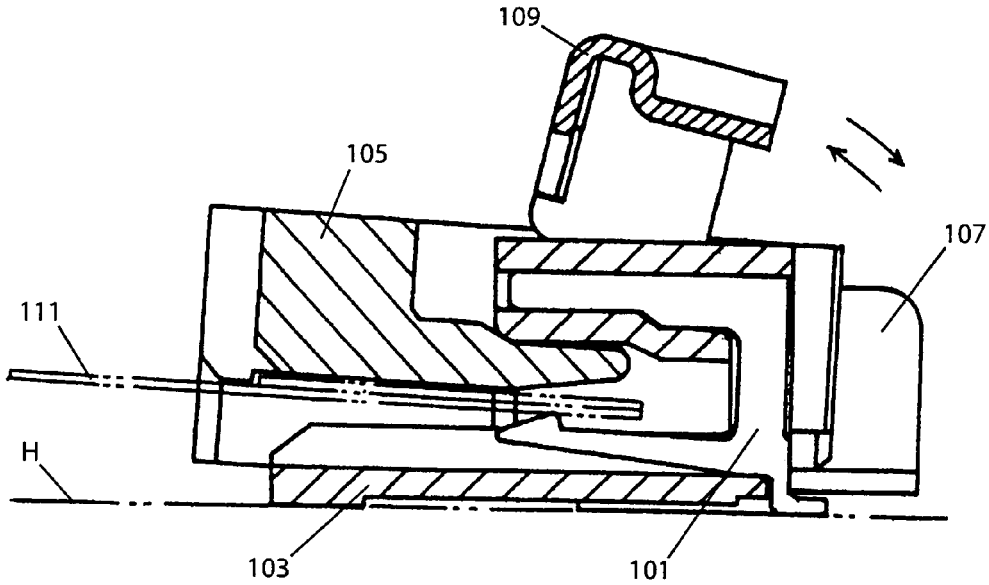
FIG. 12A shows a cross-sectional side view of a conventional connector prior to locking.
Figure 12B:
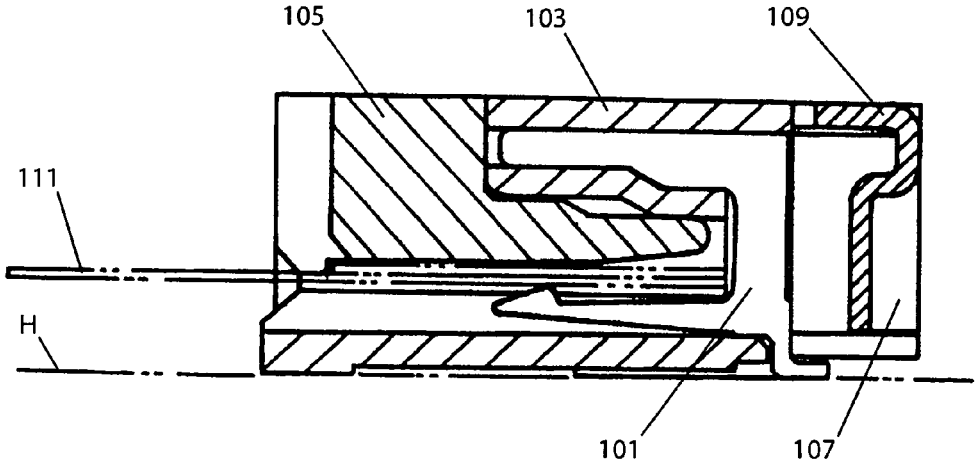
FIG. 12B shows a cross-sectional side view of the conventional connector of FIG. 12A after locking.

For example, as shown in FIG. 11, although a plurality of contacts 50*a* on housing 10 are formed in two rows which are symmetrical with respect to center line 26*a*, one row is shifted ½ pitch with respect to the other row. Corresponding to this, although FPC 70*a* has two rows of contact parts 72 symmetrical with respect to center line 76*a* of FPC 70*a*, one row is shifted by ½ pitch with respect to the other row.

In the above embodiments, with FPC 70, circuit patterns 73 are formed separately on the surface (the surface where the contact parts are formed) and undersurface. With FPC 70*a*, all of the circuit patterns 73*a* are formed on the surface. However, the present invention is not limited to this embodiment. With FPC 70, the present invention can have all of the circuit patterns 73 formed on either the surface or undersurface. With FPC 70*a*, the circuit patterns 73*a* can be formed separated onto the surface and undersurface, or all of the circuit patterns 73*a* can be formed on the undersurface.

In the above embodiments, hooks 17 and 37 are formed on the outer wall surface of housing 10 and on arms 36 of cover 30 so that they can join with each other, and a positioning protrusion 18 is formed on at least one of the opposing surfaces. This makes the operation of guiding FPC 70 between cover 30 and insertion concavity 11 easier and makes the insertion and removal operation of cover 30 from insertion opening 11 easier. However, the present invention is not limited to this embodiment. The formation of hooks can be omitted and/or the positioning protrusion can be omitted.

In the above embodiments, joining tabs 35 are formed on cover 30, and during insertion of pressure applying part 33 into insertion concavity 11, joining tabs 35 together with pressure applying part 33 join with protruding pieces 75. This prevents FPC 70 from slipping out and accurately positions contacts 50 and contact parts of FPC 70. However, the present invention is not limited to this embodiment. Joining tabs 35 can be omitted.

In the above embodiments, positioning parts are formed by insertion stoppers 21 and joining protrusions 22. Insertion stoppers 21 stop the insertion of FPC 70, and joining protrusions 22 provide provisional positioning. As a result, positioning of FPC 70 is easy and accurate. However, the present invention is not limited to this embodiment, and positioning parts other than insertion stoppers 21 and joining protrusions 22 can be used.

What is claimed is:

1. A connector for a flexible board, comprising:

a housing in which an insertion concavity is formed;

a plurality of contacts which are retained in said housing and have at least one contact part that faces an inside of said insertion concavity; and a cover having a pressure applying part which is insertable into and removable from said insertion concavity;

wherein said at least one contact part of said plurality of contacts are arranged in two rows along opposing inner walls of said insertion concavity; and wherein, by inserting said pressure applying part into said insertion concavity, a flexible board guided between said cover and said insertion concavity is pushed and deformed and is held interposed between said cover and said insertion concavity, and wherein at least one contact part of said flexible board contacts a contact part of a corresponding contact in said housing.

2. A flexible board connector as described in claim 1, further comprising:

at least one protruding piece on said flexible board, said at least one protruding piece being shaped to approximately overlap with at least one portion of a surface at an end of said insertion concavity when said flexible board is guided between said cover and said insertion concavity; and at least one positioning part on said housing which joins with an edge of said at least one protruding piece and positions said flexible board.

3. A flexible board connector as described in claim 2, wherein said at least one positioning part comprises:

at least one insertion stopper which stops an insertion of said flexible board by contacting a front edge of said at least one protruding piece of said flexible board, and at least one joining protrusion which provisionally positions said flexible board by joining with a back edge of said at least one protruding piece.

4. A flexible board connector as described in claim 2, further comprising:

at least one joining tab on said cover on at least one side of said pressure applying part, wherein said at least one joining tab and said pressure applying part join with a surface of said at least one protruding piece during an insertion of said pressure applying part into said insertion concavity.

5. A flexible board connector as described in claim 1, further comprising:

at least one arm on said cover facing an outer wall of said housing when inserting said pressure applying part into said insertion concavity;

hooks on the outer wall of said housing and on an opposing surface of said at least one arm, said hooks joining with each other during an insertion and removal of said pressure applying part; and at least one positioning protrusion on at least one of the outer wall of said housing and said opposing surface of said at least one arm for positioning during the insertion and removal of said pressure applying part with respect to said insertion concavity.

6. A flexible board connector as described in claim 3, further comprising:

at least one joining tab on said cover on at least one side of said pressure applying part, wherein said at least one joining tab and said pressure applying part join with a surface of said at least one protruding piece during an insertion of said pressure applying part into said insertion concavity.

7. A flexible board connector as described in claim 2, further comprising:

at least one arm on said cover facing an outer wall of said housing when inserting said pressure applying part into said insertion concavity;

hooks on the outer wall of said housing and on an opposing surface of said at least one arm, said hooks joining with each other during an insertion and removal of said pressure applying part; and at least one positioning protrusion on at least one of the outer wall of said housing and said opposing surface of said at least one arm for positioning during the insertion and removal of said pressure applying part with respect to said insertion concavity.

8. A flexible board connector as described in claim 3, further comprising:

at least one arm on said cover facing an outer wall of said housing when inserting said pressure applying part into said insertion concavity;

hooks on the outer wall of said housing and on an opposing surface of said at least one arm, said hooks joining with each other during an insertion and removal of said pressure applying part; and at least one positioning protrusion on at least one of the outer wall of said housing and said opposing surface of said at least one arm for positioning during the insertion and removal of said pressure applying part with respect to said insertion concavity.

9. A flexible board connector as described in claim 4, further comprising:

at least one arm on said cover facing an outer wall of said housing when inserting said pressure applying part into said insertion concavity;

hooks on the outer wall of said housing and on an opposing surface of said at least one arm, said hooks joining with each other during the insertion and a removal of said pressure applying part; and at least one positioning protrusion on at least one of the outer wall of said housing and said opposing surface of said at least one arm for positioning during the insertion and removal of said pressure applying part with respect to said insertion concavity.

10. A connector for a flexible board, comprising:

a housing in which an insertion concavity is formed;

at least one portion of a surface at an end of said insertion concavity shaped to be approximately overlapped by at least one protruding piece on a flexible board;

at least one positioning part on said housing which joins with an edge of said at least one protruding piece so as to position said flexible board, the at least one positioning part comprising at least one insertion stopper which is operable to stop an insertion of said flexible board by contacting a front edge of said at least one protruding piece of said flexible board, and at least one joining protrusion which is configured to provisionally position said flexible board by joining with a back edge of said at least one protruding piece;

a plurality of contacts which are retained in said housing and have at least one contact part that faces an inside of said insertion concavity; and a cover having a pressure applying part which is insertable into and removable from said insertion concavity;

at least one joining tab on said cover on at least one side of said pressure applying part;

wherein said at least one contact part of said plurality of contacts are arranged in two rows along opposing inner walls of said insertion concavity, and wherein, by inserting said pressure applying part into said insertion concavity, the flexible board being guided between said cover and said insertion concavity is pushed and deformed and is held interposed between said cover and said insertion concavity, and wherein at least one contact part of said flexible board contacts a contact part of a corresponding contact in said housing, and wherein said at least one joining tab and said pressure applying part are configured to join with a surface of said at least one protruding piece during an insertion of said pressure applying part into said insertion concavity.

* * * * *